United States Patent [19]

Yokozawa et al.

[11] 4,025,178

[45] May 24, 1977

[54] ELECTROPHOTOGRAPHIC COPYING APPARATUS HAVING A DUAL CAM SYNCHRONIZING MECHANISM

[75] Inventors: Michiaki Yokozawa; Harunori Okabe, both of Tokyo, Japan

[73] Assignee: Iwatsu Electric Co., Ltd., Tokyo, Japan

[22] Filed: Jan. 31, 1975

[21] Appl. No.: 545,903

[30] Foreign Application Priority Data

Mar. 1, 1974 Japan ..... 49-23266
Mar. 1, 1974 Japan ..... 49-23772

[52] U.S. Cl. ..... 355/3 R; 271/10; 271/116; 271/273; 355/14

[51] Int. Cl.² ..... G03G 15/00

[58] Field of Search ..... 355/3 R, 3 DR, 3 BE, 355/3 TR, 14; 271/10, 114, 116, 117, 246, 273, 276, 271

[56] References Cited

UNITED STATES PATENTS

| | | | |
|---|---|---|---|
| 2,693,357 | 11/1954 | Davidson | 271/246 |
| 3,062,094 | 11/1962 | Mayo | 271/10 X |
| 3,090,616 | 5/1963 | Eichler et al. | 271/114 X |
| 3,148,601 | 9/1964 | Trumbull | 355/14 |
| 3,187,651 | 6/1965 | Eichorn et al. | 355/14 X |
| 3,825,249 | 7/1974 | Zimmer | 271/114 X |

*Primary Examiner*—L. T. Hix
*Assistant Examiner*—Kenneth C. Hutchinson
*Attorney, Agent, or Firm*—Oblon, Fisher, Spivak, McClelland & Maier

[57] ABSTRACT

In electrophotographic apparatus of the type wherein a light image is projected upon a sensitized photosensitive sheet carried by a rotary drum to form an electrostatic latent image, the latent image is developed into a visible toner image and the toner image is transfer printed onto a recording paper, means is provided for permitting projection of the light image only when other devices of the apparatus tending to produce shock or vibration are not operated and for feeding the recording paper in exact synchronism with the rotation of the drum.

2 Claims, 9 Drawing Figures

ELECTROPHOTOGRAPHIC COPYING APPARATUS HAVING A DUAL CAM SYNCHRONIZING MECHANISM

BACKGROUND OF THE INVENTION

This invention relates to electrophotographic copying apparatus capable of forming clear copies.

In electrophotographic copying apparatus of the type wherein a photosensitive sheet is mounted on the periphery of a rotary drum, an electrostatic latent image is formed on the surface of the photosensitive sheet and the latent image is developed with toner to form a toner image, the photosensitive sheet is sensitized by depositing electrostatic charge on the surface thereof, and a light image of an object is projected upon the sensitized photosensitive sheet through a slit while the drum is being rotated. Accordingly, when vibration or shock caused by the operation of the mechanisms of the copying machine other than the exposure device is transmitted to the exposure device or the rotary drum when it operates, the reproduced copy is not clear or is obscured. This phenomenon will be described in detail with reference to FIG. 1 of the accompanying drawing. In conventional electrophotographic copying apparatus, a charging device 1, an optical system 7, a developing device 2, a transfer printing device 3 and a cleaning device 4 are disposed so as to surround a rotary drum 5 provided with a photosensitive sheet, not shown. The optical system includes a suitable slit, not shown, and projects the light image of an original 6 into the photosensitive sheet through the slit thus forming an electrostatic latent image, corresponding to the projected light image on the surface of the photosensitive sheet. The latent image is then developed into a visible toner image and the toner image is transfer printed onto a recording paper sent from a paper feeding device 8, in a manner well known in the art. In order to precisely transfer print the toner image onto the recording paper, it is necessary to advance beforehand the recording paper to a position immediately before the transfer printing device 3. Accordingly, the paper feeding device 8 should commence its operation when the exposure device operates. The conventional paper feeding device 8 is constructed to be actuated by a cam 9 mounted on the shaft of the rotary drum 5 for the purpose of reducing the size of the copying apparatus and for the purpose of operating the paper feeding device in synchronism with the rotation of the rotary drum 5. For this reason the rotary movement of a paper feed roller 10 which is rotated by an electric motor, not shown, is transmitted to the rotary drum 5 via a lever (shown by dot and dash lines in FIG. 1) and the cam 9 thereby causing the drum to vibrate.

Where the paper feeding device is provided with a cutter K as shown in FIG. 2 for severing a web of the recording paper paid out from a roll of the paper X for successively cutting the paper into a predetermined length, the vibration or shock generated by the operation of the cutter or paper feeding roller 10 is transmitted to the rotary drum 5 thereby producing obscure copies. Such shock or vibration is also produced by the operation of some of the other devices of the copying machine and is also transmitted to the exposure device, thus obscuring the reproduced image.

In the electrophotographic copying apparatus of the class described above it is also necessary to synchronize the operation of the paper feeding device with the rotation of the rotary drum in order to provide the recording paper at a predetermined area of the drum, that is, the image forming area of the photosensitive sheet.

To this end, there have been proposed a number of synchronous operating devices. According to one prior art device, a paper feeding roller is rotated continuously, and the roller is urged against the rotary drum in synchronism with the rotation thereof thus feeding the recording paper. According to another prior art device, the paper feed roller is normally held in contact with the recording paper and the rotation of the paper feed roller is started in synchronism with the rotation of the rotary drum. In each case, smooth feeding of the paper or accurate synchronism is difficult to obtain because the roller slips on the surface of the recording paper when the roller is started to rotate or brought into contact with the paper due to the resistance caused by the friction acting between adjacent sheets of the paper which are laminated. Furthermore, in a copying apparatus which is constructed such that the rotary drum is rotated one more revolution than the number of the recording papers, the rotation of the drum and the paper feeding operation are not always in synchronism.

SUMMARY OF THE INVENTION

Accordingly, it is an object of this invention to provide an improved electrophotographic copying apparatus capable of producing clear copies.

Another object of this invention is to provide an improved electrophotographic copying apparatus including means for preventing the projection of the light image while other elements of the apparatus which generate vibration or shock are operated thereby preventing the reproduced copies from becoming obscure.

Still another object of this invention is to provide an electrophotographic copying apparatus provided with an improved apparatus for feeding recording papers to the rotary drum for transfer printing capable of feeding the recording paper with a precise synchronism with the rotation of the rotary drum.

According to this invention, there is provided electrophotographic copying apparatus of the type comprising a rotary drum provided with a photosensitive sheet wrapped about its periphery, means for depositing an electrostatic charge on the photosensitive sheet, an exposure device for projecting a light image upon the photosensitive sheet for forming an electrostatic latent image corresponding to the light image, a developing device for developing the latent image with a toner for producing visible toner image on the photosensitive sheet, a recording paper feeding device for successively feeding recording papers to the rotary drum and a transfer printing device for transfer printing the toner image upon the recording paper while it is urged to the periphery of the rotary drum, characterized by means for operating the exposure device only when at least one of the devices described above which generates vibration or shock which is transmitted to the rotary drum is not operated.

According to another aspect of this invention there is provided apparatus for feeding a recording paper to electrophotographic copying machine for transfer printing thereon a toner image formed on a photosensitive sheet carried by a rotary drum, said apparatus comprising a magazine for holding a stack of the recording papers, a recording paper feeding roller disposed above the stack, a first arm for moving the roller toward and away from the stack, a first cam mounted on the shaft of the rotary drum for operating the first arm to dispose the recording paper feeding roller on the stack, means for rotating the recording paper feeding roller to feed the uppermost sheet of the stack toward the rotary drum in a predetermined timed relationship with the rotation of the rotary drum, an intermediate roller disposed between the stack and the rotary drum for temporarily arresting the recording paper fed by the recording paper feeding roller, and means for driving the intermediate roller for feeding the temporarily arrested recording paper to the rotary drum in synchronism with the rotation of the rotary drum.

DESCRIPTION OF THE PREFERRED EMBODIMENTS

Figure 1:
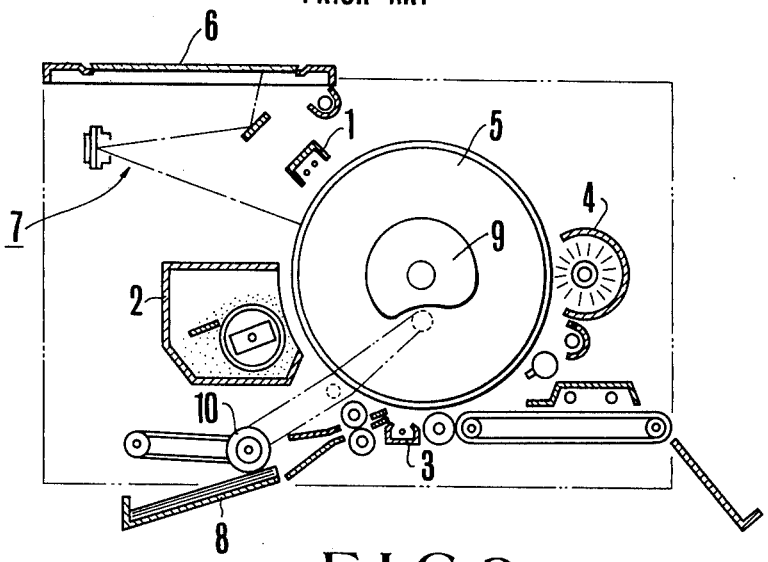
FIG.1 PRIOR ART
FIG. 1 is a diagrammatic sectional view showing various elements of prior art electrostatic copying machine.
Figure 2:
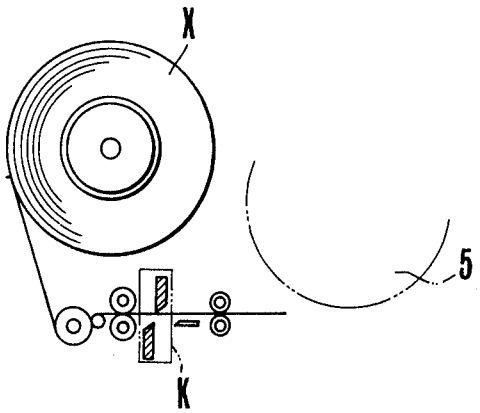
FIG.2 PRIOR ART
FIG. 2 is a diagram showing another example of the prior art recording paper feeding device.
Figure 3:
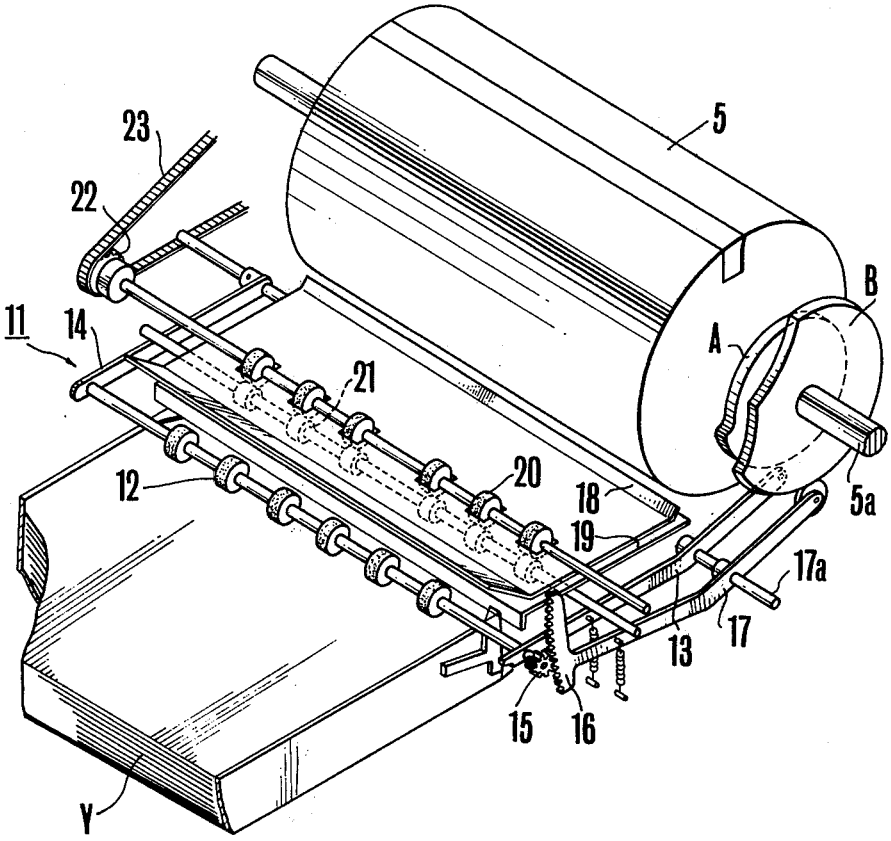
FIG. 3 is a perspective view of a novel recording paper feeding device constructed in accordance with the invention.

Turning now to FIG. 3 of the accompanying drawings, the recording paper feeding device 11 shown therein comprises a plurality of feed rollers 12 supported by a pair of arms 13 and 14 to be seated on the uppermost sheet of a plurality of laminated recording papers Y, a pinion 15 secured to the shaft of the feed rollers 12, a sector gear 16 supported by an arm 17 an engaged with the pinion 15, and a pair of cams A and B secured to the shaft 5*a* of the rotary drum 5 for operating arms 13 and 17 respectively.

Figure 4:
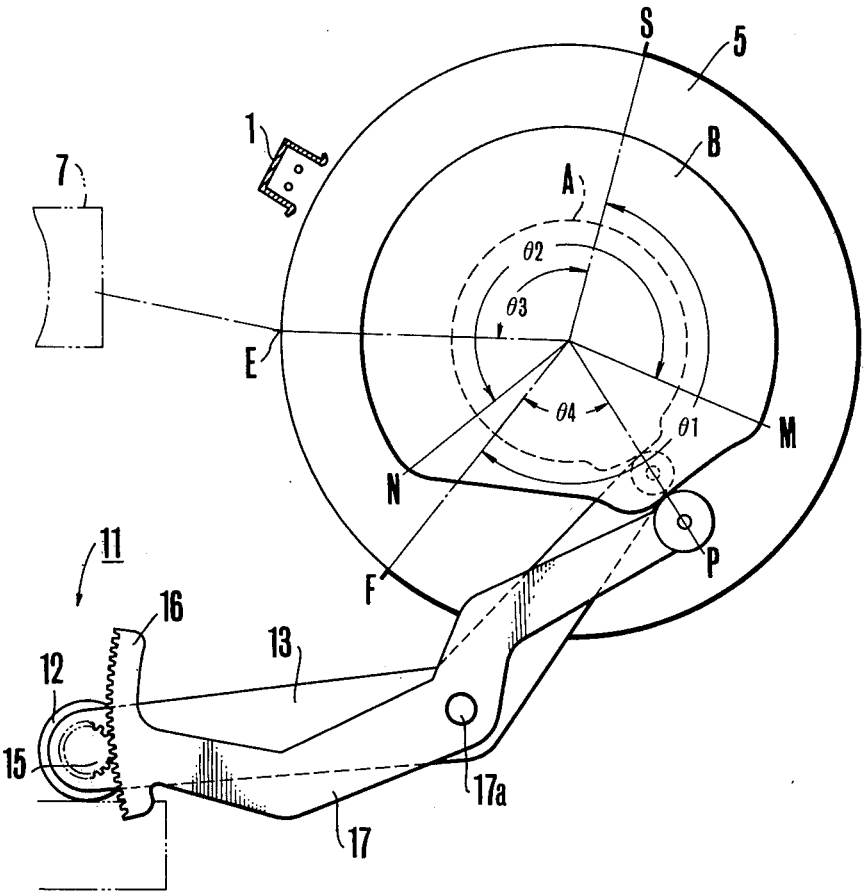
FIG. 4 is an enlarged view of a portion of the recording paper feeding device shown in FIG. 3.

FIG. 4 shows the operative relationship between cams A and B, arms 13 and 17 and the exposure device. The region about the periphery of the drum 5 on which the toner image is to be formed is shown by a thick line extending between points S and F and subtending an angle $\theta_1$. For the reason described later, the following description will be made with reference to cam B. The angle subtended by a region (between points N and M) in which the arm 17 supporting the sector gear 16 is held stationary is expressed by $\theta_2$.

Let us denote the angle between point S and the exposure position E on the drum 5 by $\theta_3$ and the angle between point F and point P at which the cam B engages a cam follower roller mounted on the arm 17 by $\theta_4$ and when angles $\theta_3$ and $\theta_4$ are selected to satisfy a relation $\theta_3 \geqq \theta_4$,then before point S reaches the exposure position E to commence projection of the light image, the paper feeding operation has already been completed. As the drum 5 and cam B are rotated further to bring point F to the exposure position E the drum is rotated over an angle of $(\theta_1 + \theta_3)$. If angles $\theta_1$ through $\theta_4$ are selected to satisfy the relation $$(\theta_3 + \theta_1) \leqq (\theta_2 + \theta_4)$$

then the paper feeding operation will not be commenced when the exposure is finished. For this reason, during the exposure which is performed in the light image projecting region about the periphery of the rotary drum 5, the gear operating arm 17 is held stationary as will be described later. The foregoing description refers to cam B because the angle subtended by the region of cam B in which the arm 17 is operated is larger than the angle subtended by the raised portion of cam A in which arm 13 is operated, and because the latter angle is included in the former angle. For this reason, when the angle subtended by the raised portion of cam A is larger than angle $\theta_4$, cam A is used to attain the object of this invention, whereas when the angles subtended by the operating regions of cams A and B do not overlap each other, the sum of these two angles, that is, $\theta_2$, is used.

Referring again to FIG. 3, between the lamination of the recording papers Y and the rotary drum 5 is provided a paper passage defined between two flat sheets 18 and 19. These sheets are provided with windows in which pairs of guide rollers 20 and 21 are provided to contact each other. The rollers 20 are driven by an electric motor, not shown, through means of a sprocket wheel 22 mounted on the shaft of the rollers 20 and a driving chain 23 meshing with the sprocket wheel 22.

In operation when cams A and B are rotated together with rotary drum 5, arms 13 and 17 are swung in the vertical direction about a pivot pin 17*a*. As the arm 13 is rotated in the counterclockwise direction the feed rollers 12 are pressed onto the uppermost sheet of the recording paper Y, and as the arm 17 is rotated in the same direction sector gear 16 rotates rollers 12 to advance the recording paper by a predetemined distance. The advanced paper, however, is arrested by intermediate rollers 20 and 21 and then advanced to the transfer printing position only when intermediate rollers 20 are rotated in synchronism with the rotation of the drum 5.

During the paper feeding operation, shocks or vibrations generated by or transmitted to arms 13, 17, or the like are transmitted to drum 5 via cams A and B, but as described hereinabove, during the operation of the paper feeding device 11, that is while cam B engages the cam follower roller on the arm 17 in the complementary angle of angle $\theta_2$, the light image projecting region $\theta_1$ of the drum 5 does not yet arrive at the exposure position E so that such vibrations or shocks do not in any way affect the exposure. When point S of the drum 5, that is, the leading end of the light image projecting region indicated by the thick line reaches the exposure position E, due to the established relation $\theta_2 \geqq \theta_3$, the paper feeding operation has already been completed and the paper feeding device 11 is held stationary. Since $\theta_2 \geqq \theta_1$, this condition is maintained until the exposure operation is completed. Although, in many cases, the feeding of the recording paper by the intermediate rollers 20 and 21 is carried out during the exposure, these rollers are rotated relatively gently so that the rotation thereof does not affect the exposure or the quality of the reproduced copies.

In this manner, the recording paper feeding device is operated only when the light image is not projected, and the light image is projected only when the recording paper feeding device is not operated, so that it is possible to produce clear copies.

Although a timed operation of the exposure device and the recording paper feeding device has been described, it will be clear that other devices that generate vibrations or shocks such as the transfer printing device, conveyer and cleaning device can also be operated while the light image is not projected.

The construction and operation of the recording paper feeding device will be described in more detail with reference to FIG. 5 and FIGS. 6*a* to 6*d*. The sheets of recording papers Y are stacked in a magazine 111 positioned near the rotary drum 102. A plurality of rollers 112 are mounted on a shaft 113 with its opposite ends supported by one end 114*a* and 115*a* of a pair of arms 114 and 115 extending along the opposite sides of the magazine 111. To the lefthand end of shaft 113 is connected a pinion 117 through a one way clutch 116 for meshing with a sector gear 119 as will be described later in detail. The opposite ends 114*b* and 115*b* of the supporting arms 114 and 115 are pivotally mounted on a pivot shaft 120 rotatably journalled by the side frame, not shown, of the copying apparatus so that the arms 114 and 115 can swing substantially at the same time. A cam follower roller 121 is mounted on the end 114*b* of arm 114 so as to be operated by the cam A secured to the shaft 102*a* of the rotary drum 102. A spring 122 is connected to arm 114 for biasing the same in the clockwise direction. A locking lever 124 operated by a solenoid coil 123 is provided to engage the outer end of arm 114 for arresting the clockwise rotation of arm 114. Although not shown in the drawing, an electric operating circuit is provided for the solenoid coil 123 for releasing the arm during a predetermined portion of one revolution of the rotary drum 102.

The sector gear 119 is secured to one end of an arm 118 which is pivotally mounted on the pivot shaft 120 and biased in the clockwise direction by a tension spring 125. A cam follower roller 126 operated by cam B also mounted on drum shaft 102*a* is mounted on the opposite end of arm 118.

Two parallel thin sheets of metal 127 and 128 are provided between the drum 102 and magazine 111 to define a paper passage 129 with one end positioned at the same level as the uppermost sheet of the recording paper and the other end beneath the drum 102. Similar to a conventional printing machine, suitable means may be provided for the magazine to maintain the uppermost sheet at a definite level as the sheets are successively. A plurality of openings 130 are provided through sheets 127 and 128 at intermediate points thereof for receiving intermediate rollers 132 and 133 which are mounted on shafts 134 and 135, respectively. A sprocket wheel 137 is mounted on one end of shaft 134 to be driven by means of a driving chain 136.

The recording paper feeding device shown in FIG. 5 operates as follows. When the rotary drum 102 is stationary or before commencing the paper feeding operation, the arm 114 is maintained by cam A and locking lever 124 in a position to hold rollers 112 out of contact with the recording paper whereas arm 118 is maintained by cam B in a position to hold sector gear 119 at a position above the stack of the recording papers, as shown in FIG. 6*a*. Upon reception of a command signal for starting the recording paper feeding operation, the solenoid coil 123 disengages the locking lever 124 from arm 114 thereby permitting cam A and spring 122 to rotate arm 114 in the clockwise direction. Accordingly, the rollers 112 are lowered so as to rest on the uppermost sheet of the recording paper Y. At this time, arm 118 is also rotated in the clockwise direction by cam B and spring 125 so as to lower the sector gear 119 thus rotating pinion 117. When the sector gear 119 is lowered at a speed less than that of rollers 112 and pinion 117, the gear 119 will rotate the pinion 117 in the clockwise direction. Since the one way clutch 116 is constructed to transmit to rollers 112 only the clockwise rotation of pinion 117, the rollers are rotated under these conditions. Thus, the rollers 112 supply recording paper when rollers 112 are caused to engage the recording paper. To eliminate this trouble it is necessary to make the rotary speed of the sector gear 119 and its supporting arm 118 to be equal or slightly faster than that of arm 114. Then, a short time after the rollers 112 rest on the recording paper as shown in FIG. 6*b*, the sector gear 119 will be stopped with its upper end meshed with pinion 117, as shown in FIG. 6*c*. Thereafter, the arm 118 and sector gear 119 are rotated in the counterclockwise direction by the action of cam B to rotate pinion 117 and rollers 112 in the clockwise direction while rollers 112 are held in the lowered position by cam A. As a result of the rotation of rollers 112, the uppermost sheet of the recording paper Y is advanced toward the rotary drum 102. The forward movement of the recording paper is arrested when it reaches intermediate rollers 132 and 133 whereby the forward end of the recording paper is flexed as shown in FIG. 6*d*. When rollers 132 and 133 are started to rotate by driving chain 136 in response to a synchronizing pulse, the recording paper is advanced to the transfer printing position. Thereafter rollers 112 are raised to the position shown in FIG. 6*a* by cam A. If feeding of the recording paper is not necessary during the following rotation of the drum 102, solenoid coil 123 is deenergized so as to release the locking lever 124 whereby the spring 124 is caused to lock arm 114 by means of the force of spring 138.

Figure 5:
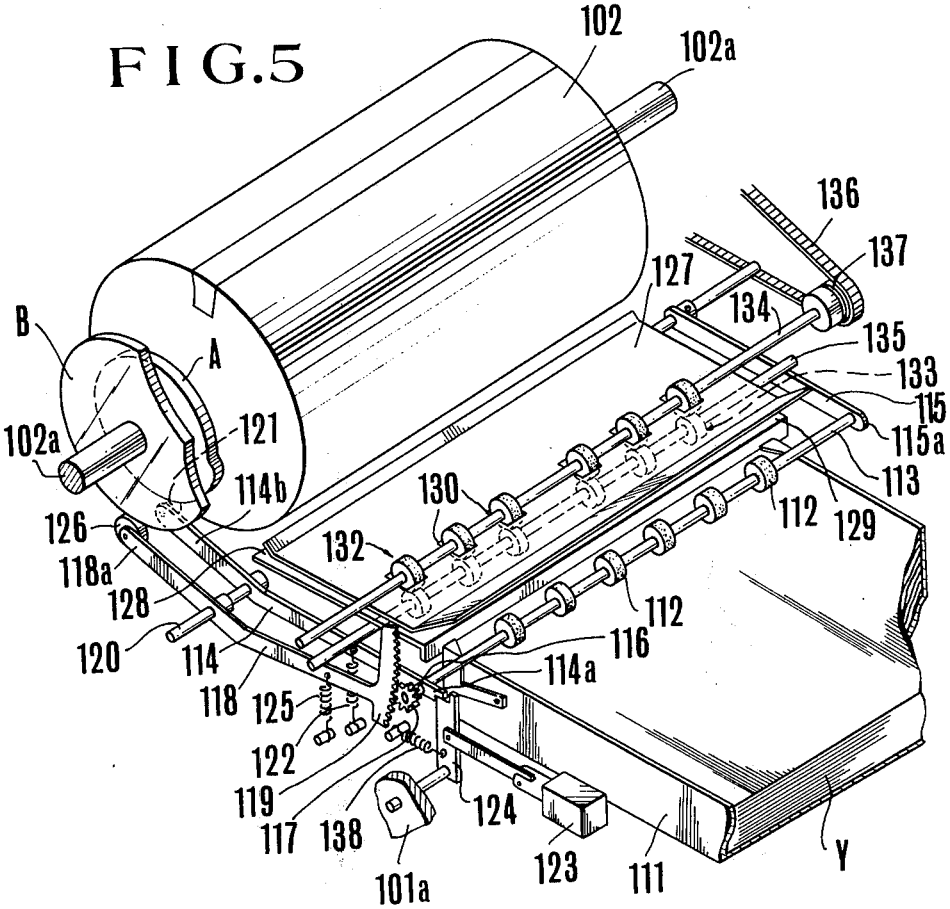
FIG. 5 is a perspective view showing the detail of the construction of the novel recording paper feeding device.
Figure 6A:
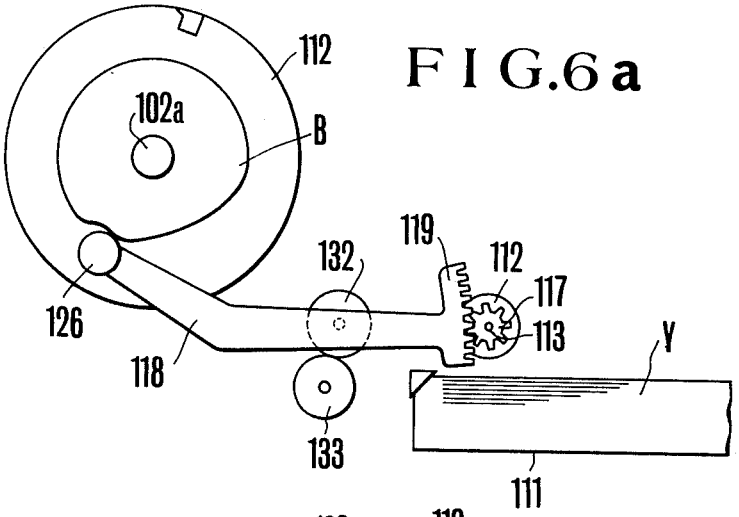
FIGS. 6*a* to 6*d* are partial side views to explain the paper feeding operation.
Figure 6B:
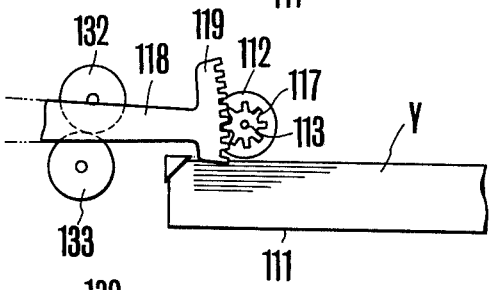
Figure 6C:
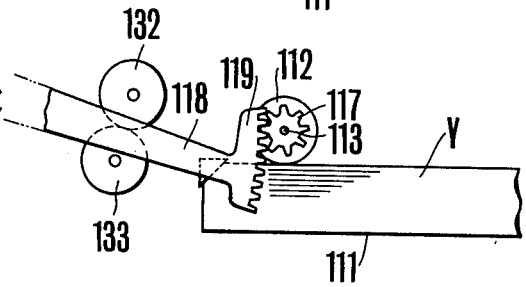
Figure 6D:
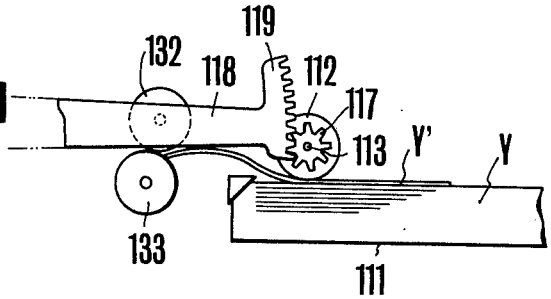

Thus, the feeding apparatus shown in FIG. 5 operates to correctly feed the recording paper to the rotary drum in exact synchronism with the rotation of the rotary drum.

It should be understood that the invention is not limited to the specific embodiments illustrated and that many changes and modifications may be made without departing from the scope of the invention as defined in the appended claims. For example, any known type of photosensitive sheet and any known methods of forming toner images and transfer printing the same can be used. Furthermore, the solenoid coil 123 may be replaced by means of a timing cam mounted on the rotary drum.

What is claimed is:

1. In an electrophotographic copying apparatus including a rotary drum having a shaft and a photosensitive sheet wrapped around the periphery of said rotary drum and having a toner image formed thereon, apparatus for feeding recording paper to said rotary drum for transfer printing the toner image upon said recording paper comprising: a magazine for holding a stack of recording paper, a recording paper feeding roller disposed above said stack, a first arm for moving said roller toward and away from said stack, a first cam mounted on the shaft of said rotary drum for operating said first arm to dispose said recording paper feeding roller on said stack, a second cam mounted on the shaft of said rotary drum, a second arm pivotally supported by the stationary portion of the apparatus with one end operatively connected to said second cam, a segmental gear mounted on the other end of said second arm, a pinion driven by said segmental gear for driving said recording paper feeding roller to feed the uppermost sheet of said stack toward said rotary drum in a predetermined timed relationship with the rotation of said rotary drum, an intermediate roller disposed between said stack and said rotary drum for temporarily arresting said recording paper fed by said recording paper feeding roller, and means for driving said intermediate roller for feeding said temporarily arrested recording paper to said rotary drum in synchronism with the rotation of said rotary drum.

2. The apparatus according to claim 1 wherein said pinion is connected to said recording paper feeding roller through means of a one way clutch.

* * * * *